US005820342A

United States Patent [19]

Au et al.

[11] Patent Number: 5,820,342

[45] Date of Patent: Oct. 13, 1998

[54] FLUID FORCING DEVICE WITH A FLUTED ROLLER DRIVE

[76] Inventors: Ching Yin Au, P.O. 31205, Greenwich, Conn. 06831-0905; Lawrence Au, 5904 N. 5th St., Arlington, Va. 22203

[21] Appl. No.: 767,019

[22] Filed: Dec. 16, 1996

[51] Int. Cl.[6] ..... F03D 5/06

[52] U.S. Cl. ..... 416/82; 416/80; 417/436; 440/16

[58] Field of Search ..... 416/82, 83, 79, 416/80, 81; 417/436; 440/16

[56] References Cited

U.S. PATENT DOCUMENTS 144,538 11/1873 Harsen ..... 416/81

3,620,651 11/1971 Hufton ..... 416/81

FOREIGN PATENT DOCUMENTS 836006 4/1952 Germany ..... 417/436

564018 9/1944 United Kingdom ..... 440/16

*Primary Examiner*—John T. Kwon

[57] ABSTRACT

A fluid forcing device comprising many rotatable slender elements that converts mechanical energy into fluid energy by mechanically arranging and maintaining, at all time, the rotatable slender elements in a predetermined wave form and by mechanically moving the wave form in a direction normal to the rotation of the elements by an improved drive comprising two fluted rollers. The new drive reduces the weight and complexity of the entire fluid forcing device and renders it more mechanically rigid and less vibration prone.

4 Claims, 6 Drawing Sheets

FLUID FORCING DEVICE WITH A FLUTED ROLLER DRIVE

BACKGROUND OF THE INVENTION

This invention relates to an improvement to the prior mechanical drive system employed in the U.S. patent application Ser. No. 08/626,566 (now U.S. Pat. No. 5,611,666) by Au et al.

The prior system utilizes roller chains to move wedges in a time-controlled manner, the wedges controlling a set of rotatable elements to produce a moving wave-form of the rotatable elements.

In the system, two roller chains are needed, and two sets of driving arms are needed connecting the rotatable elements to the roller chains. The roller chains are inherently vibration prone because of their mechanical flexibility.

It is an object of this invention to provide a new and compatible mechanical drive system for the fluid forcing device similar to U.S. patent application Ser. No. 08/626,566 by Au et al.

It is another object of this invention to reduce system weight and complexity replacing the the two sets of arms with a single set of arms.

It is another object of this invention to replace the two roller chains with a drive system that is much simpler, more rigid mechanically and therefore much less vibration prone.

The following describes a mechanical drive system capable of driving the wave forming rotatable elements similar to elements in U.S. patent application Ser. No. 08/626,566 by Au et al.

SUMMARY OF THE INVENTION

A simple embodiment of the improved mechanical driving system comprises two fluted rollers horizontally mounted on a protective tray modified to support the two rollers; a timing gear on the end of each roller; a timing belt to link and to synchronize the two rollers, and a pulley for power input.

The two rollers are similar in shape. They are mounted in close proximity to each other and side-by-side in a horizontally orientation.

The length of the rollers equals one wave-length of the moving wave described in U.S. patent application Ser. No. 08/626,566 by Au et al. Each roller has a helical flute of exactly one cycle; the flute spirals along each of the rollers, so that the angular position of the flute at one end of each roller spirals along the roller to the same angular position on the other end of the same roller. The flute is a groove so wide that the prominent part of the roller consists of a narrow helical ridge. The fluted rollers are hereinafter also referred to as helical rollers.

The outer shape of the helical ridge is curved to follow the apex and trough shapes of the moving wave-form. The rotation of the helical rollers controls the movement of the driven arms, so that the apex driven arm position and trough driven arm position will move longitudinally and parallel to the helical rollers.

The precise shape of the flute of the helical rollers provides clearance to place the two helical rollers close enough together to drive a single set of driven arms from both sides. This single set of driven arms controls the position of rotatable elements immersed in fluid. The rotatable elements are similar to rotatable elements in U.S. patent application Ser. No. 08/626,566 by Au et al which form a moving wave.

DETAILED DESCRIPTIONS

Figure 1:
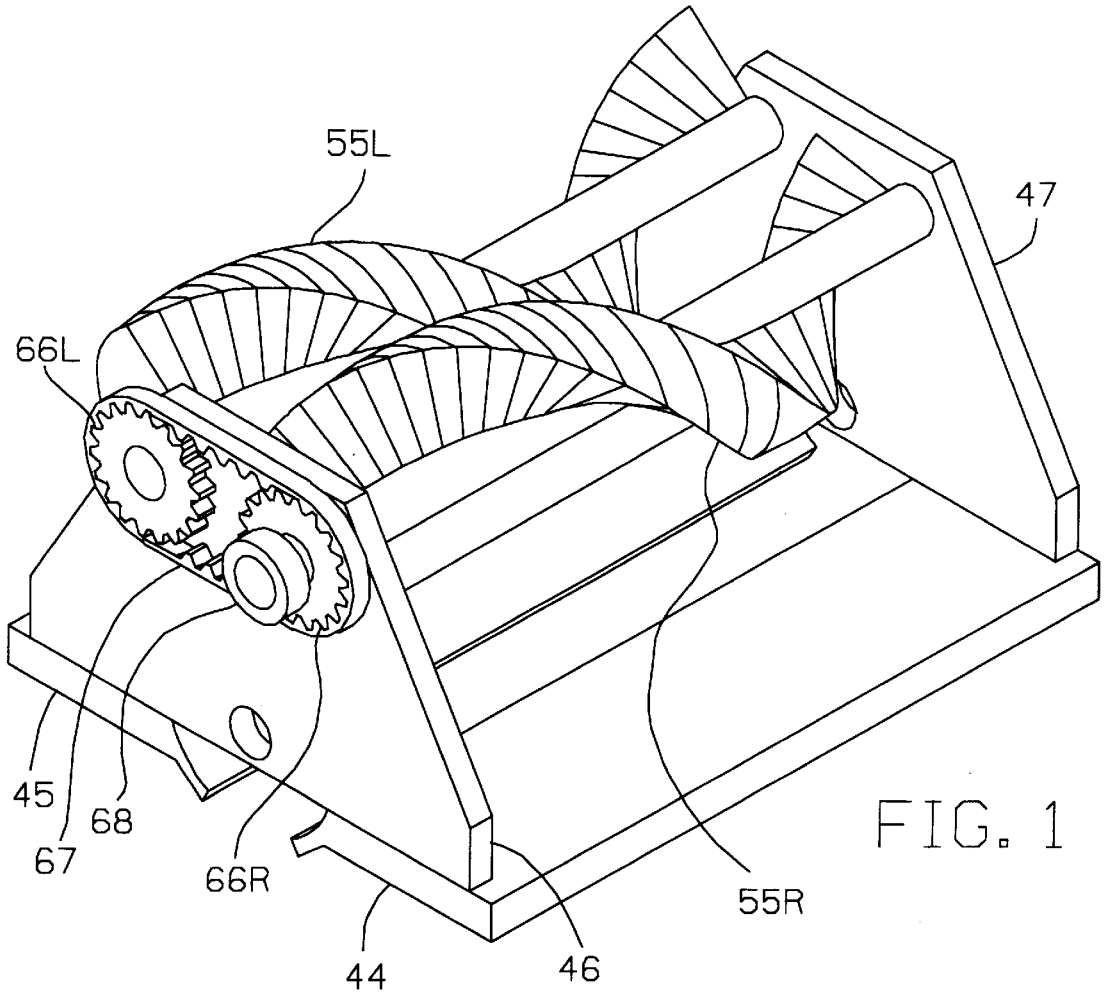
FIG. 1 is an isometric view of the helical rollers of the improved mechanical driving system.

Referring to FIG. 1, shown as 55L and 55R are the left and right helical rollers respectively, mounted parallel to each other on the front support plate 46 and the rear support plate 47 of the protective tray. Each helical roller has a wide helical flute and a narrow helical ridge. The ridge of each roller is rendered more visible by the addition of many sectional outline-stripes. These outline-stripes clearly show that the outermost surface of the helical ridge is a spiraling curved surface designed to form a moving wave of the rotatable elements.

If a vertical plane is introduced on the right side of and parallel to the right helical roller so that the plane contacts the outermost part of the ridge's curved surface, that contact point will move linearly in the direction parallel to the roller when the roller is rotated either clockwise or counter-clockwise. This action is further demonstrated in the next two figures.

FIG. 1 also shows that left helical roller has a timing gear 66L attached to one end and the right helical roller has a timing gear 66R and an input pulley 68 attached to one end. A timing belt 67 couples the two timing gears to synchronize the rotation of the two rollers. FIG. 1 also shows the right bottom plate 44 and the left bottom plate 45, both attached to the front support plate 46 and rear support plate 47 to form a protective tray. Both the front support plate and the rear support plate have a bearing hole provided for the installation of the central axle and the rotatable elements.

Figure 2:
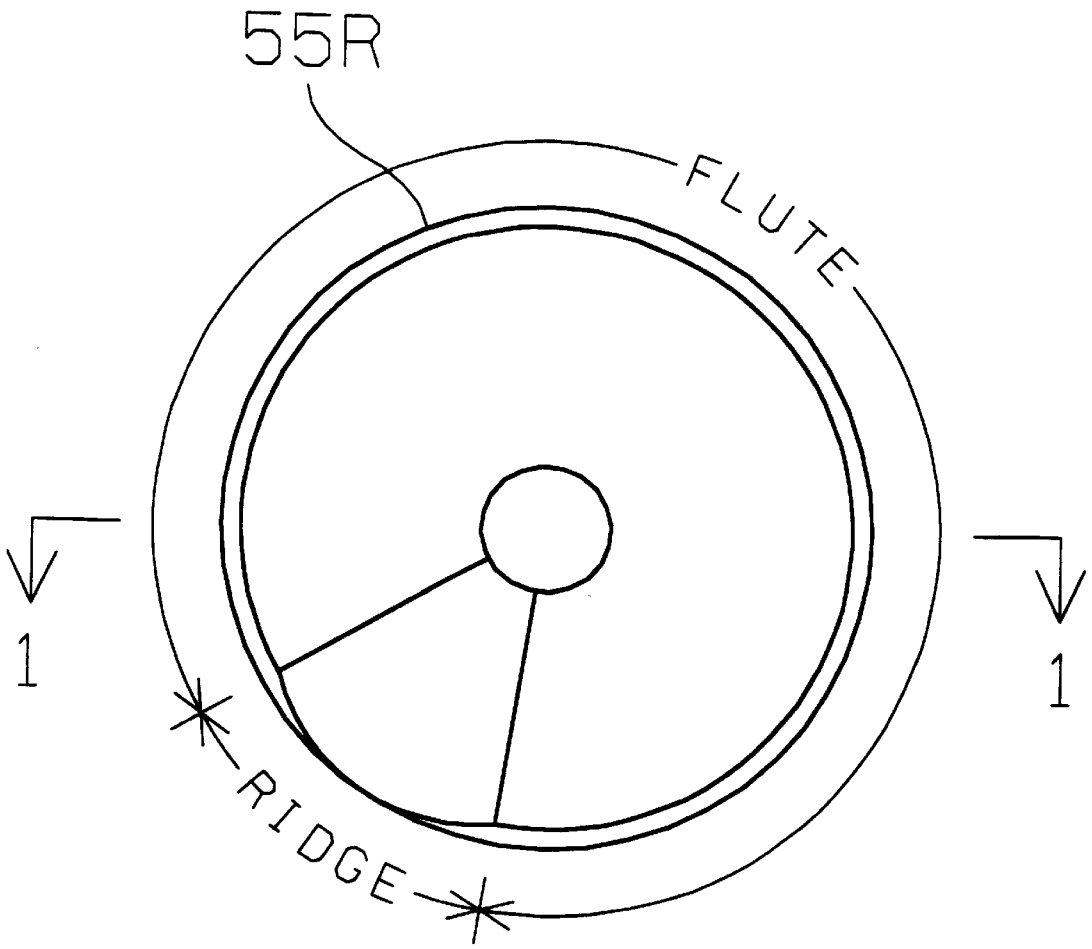
FIG. 2 is an end view of the one of the helical rollers.

FIG. 2 is an end view of the right helical roller 55R. The angular ranges of the flute and the ridge at the end of the roller are identified.

Figure 3:
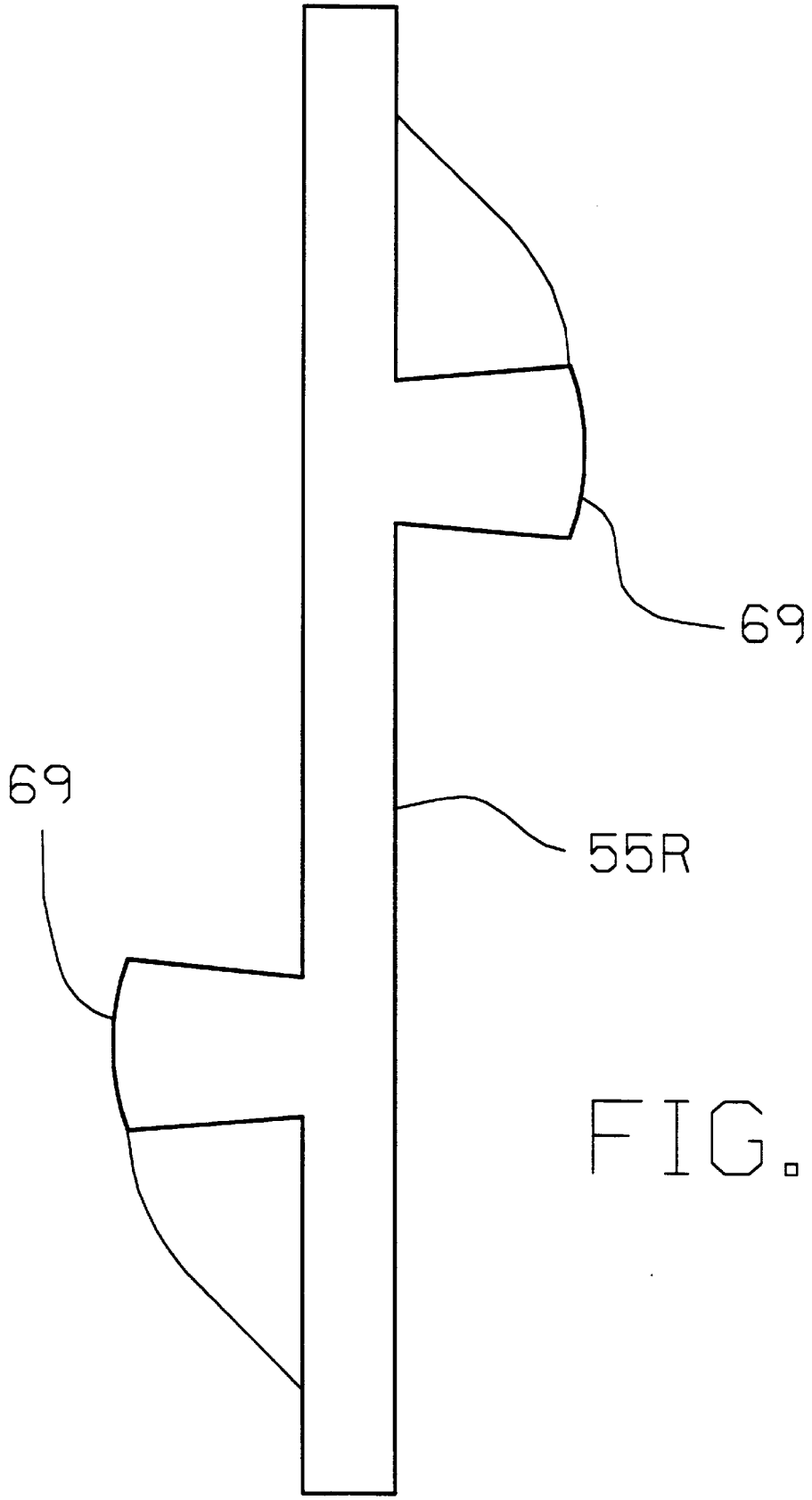
FIG. 3 is section 1—1 of FIG. 2, showing the curved driving surface of the helical ridge of the helical roller.

FIG. 3 is section 1—1 of FIG. 2. The outline of the section is shown in bold lines. The ridge is cut by the sectioning in two locations, one at left and one at right. Both locations show a curve 69, which is designed to fit the apex and trough of the moving wave. The curve at left is the one that is used to move the apex. When the right roller 55R is rotated counter-clockwise, the left curve 69 will move linearly away from the timing gear end (lower end in figure), carrying the apex of the wave in the same direction.

Figure 4:
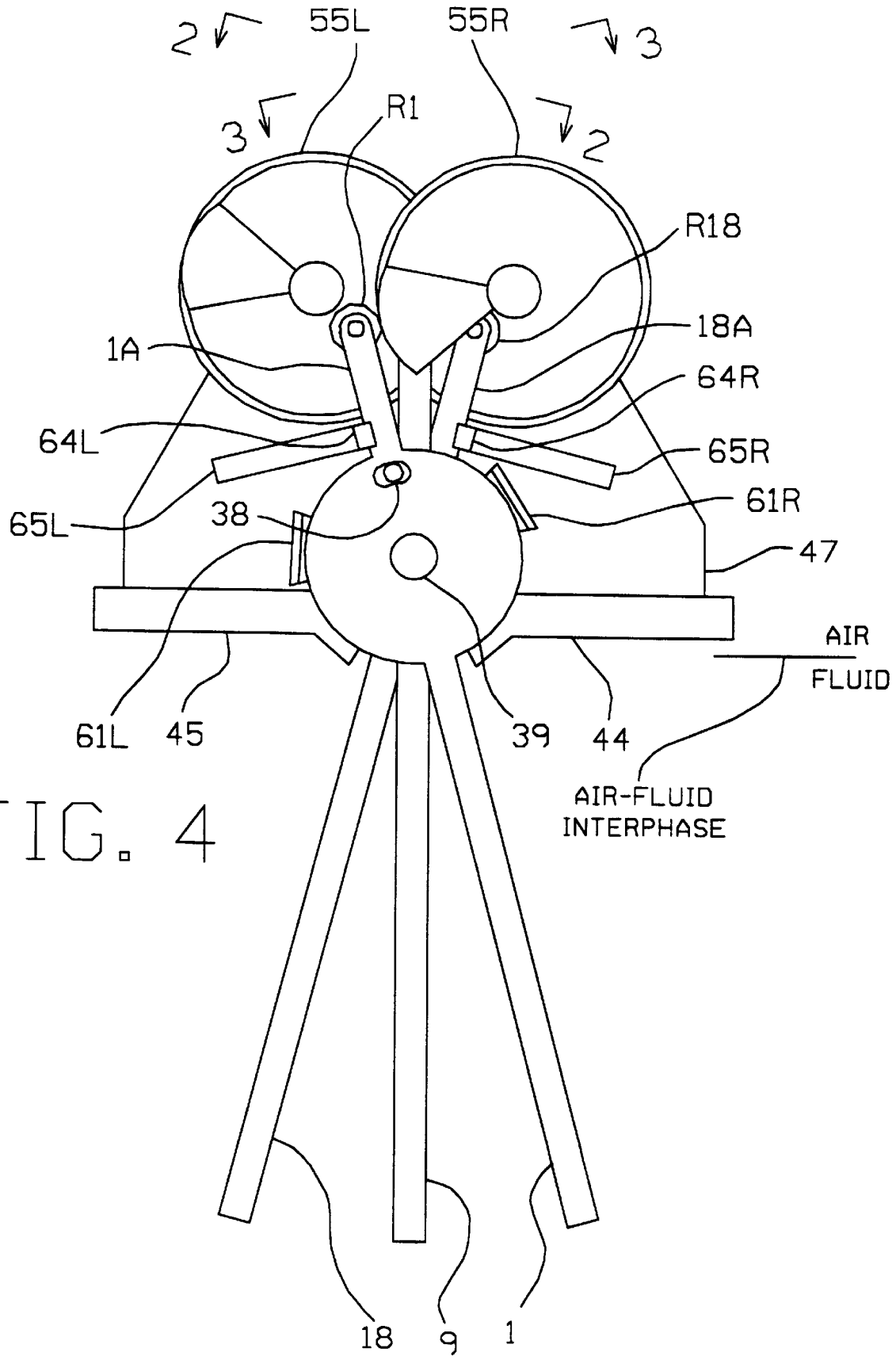
FIG. 4 is a frontal sectional view taken in front of rotatable element 1, showing the entire fluid forcing device together with the improved mechanical driving system.

FIG. 4 is a sectional view of the fluid forcing device of the above mentioned patent application with the new improved drive. The view is taken just in front of the rotatable element 1. The following components are similar to components in U.S. patent application Ser. No. 08/626,566 by Au et al: rotatable element 1 shown with just one driven arm IA and with a small roller R1, oriented to ride on the curved surface of the ridge of the right helical roller 55R. Rotatable element

18 is shown with its driven arm 18A and its small roller R18 which is actually riding on the curved surface of the ridge of the left helical roller 55L, but their contact is hidden behind part of roller 55R. Rotatable element 9 is shown with its driven arm partially obscured and not identified. Pin 38 in the slot of the rotatable element 1 is typically a pin attached to all the rotatable elements except element 1. When all the pins are nested in and restrained by the slot of the preceding element, the movement of the apex and trough of the wave is able to move the slanted parts of the wave with them. The elastic compression springs 64R and 64L, which used to be mounted on the protective tray are now mounted on their support bars 65R and 65L respectively.

Connecting bars 61R and 61L serve to connect rotatable element 1 with element 35 at the rear (not shown). Central axle 39 supports all the rotatable elements. For easy cross identification, the same numbers used in identifying the components in the above mentioned patent application are used here. The following components belong to the new improved drive system: 55R and 55L are the helical rollers. 44 and 45 are respectively the right and the left bottom plates of the protective tray. 47 is the rear vertical support plate of the tray. 47 together with the front vertical support plate 46 (not shown) supports 55R, 55L and the central axle 39.

Figure 5:
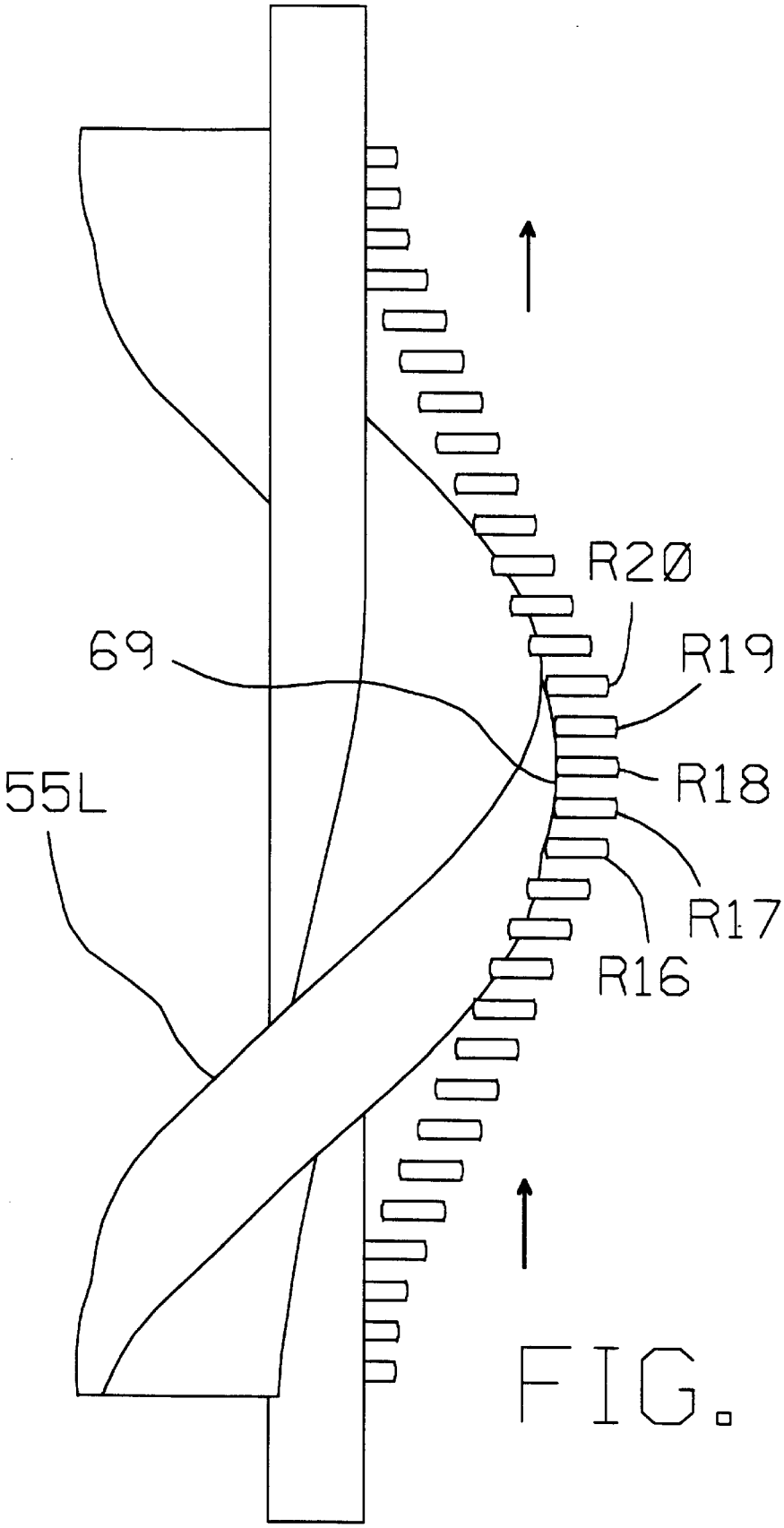
FIG. 5 is view 2—2 of FIG. 4, showing the left helical roller engaging the small rollers of the driven arms of the rotatable elements.

FIG. 5 is view 2—2 of FIG. 4. R16, R17, R18, R19 and R20 are the small rollers of the driven arms of the rotatable element 16, 17, 18, 19 and 20 respectively (not shown). At this particular moment, these five small rollers are engaged by the curved surface 69 of the left helical roller 55L to form the trough of the wave. A moment later, if 55L is rotated counter-clockwise, R16 will be disengaged and R21 (next to R20, but not identified) will be engaged. The trough is thus moved in the direction of the arrows.

Figure 6:
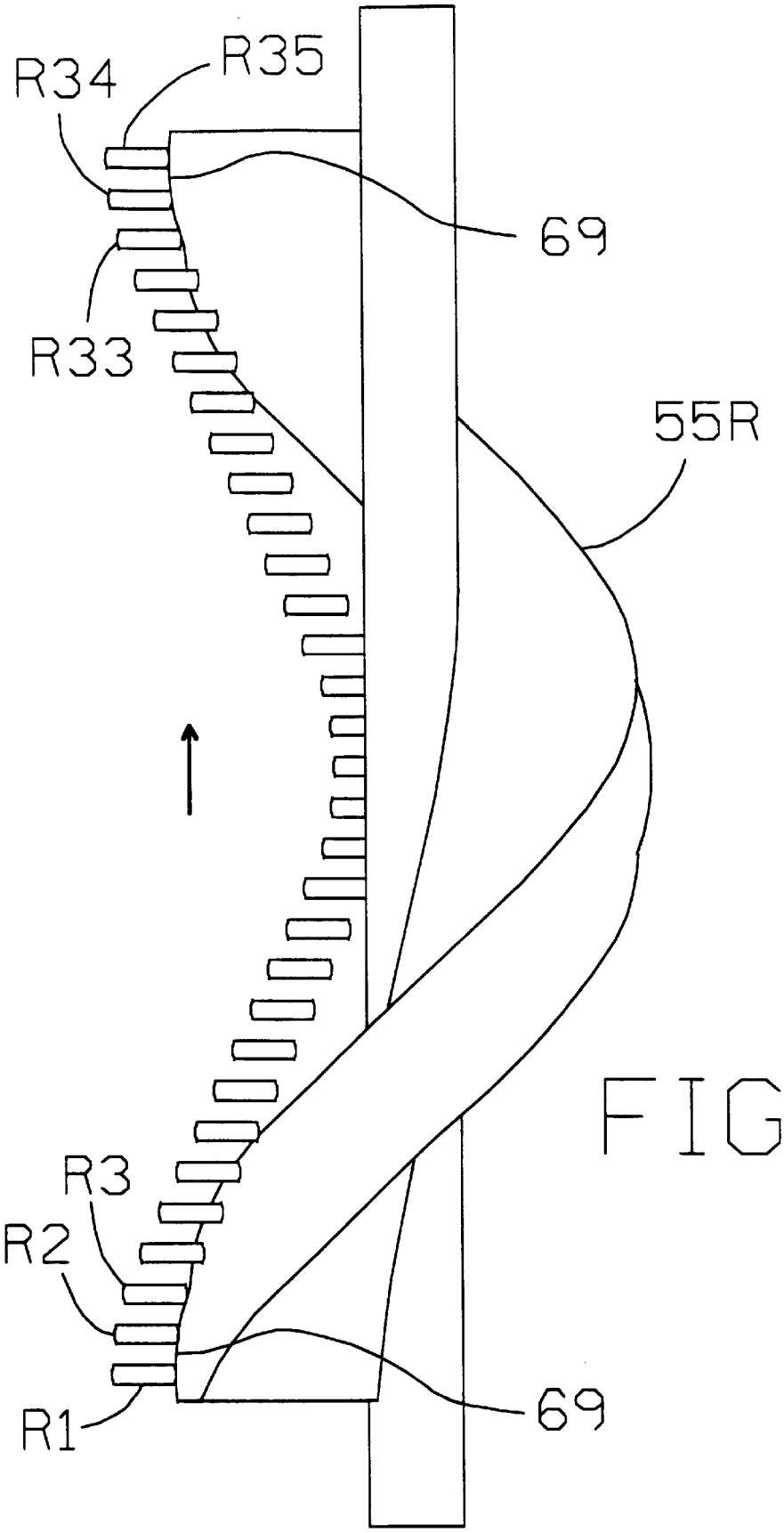
FIG. 6 is view 3—3 of FIG. 4, showing the right helical roller engaging the small rollers of the driven arms of the rotatable elements.

FIG. 6 is view 3—3 of FIG. 4. R1, R2 and R3 are the small rollers of the driven arms of the rotatable elements 1, 2 and 3 respectively (not shown). At this particular moment, these three small rollers are engaged by a portion of the curved surface 69 of the right helical roller 55R to form a portion of the apex of the wave. A moment later, if 55R is rotated counter-clockwise, R4 and R5(both not identified) will be engaged, as this partial apex is growing into a complete apex. Still a moment later, R1 will be disengaged and R6 (not identified) will be engaged; the apex is seen to move in the direction of the arrow. R33, R34 and R35 are the small rollers of the driven arms of the rotatable elements 33, 34 and 35 respectively( not shown). At this particular moment, these three rollers are engaged by a portion of the another curved surface 69 of the right helical roller 55R to form a portion of another apex of the moving wave. A moment later, if 55R is rotated counter-clockwise, R33 will be disengaged as the size of this partial apex is reduced. Still another moment later, R34 and R35 will be disengaged; this partial apex will disappear completely.

What is claimed is:

1. A fluid forcing device comprising:

a central axle;

a multiplicity of rotatable elements fitting snugly together, each element rotatable around the central axle, each element having a pin protruding in front and a curved slot of pre-set length in back, the pins and slots cooperating to limit movement of adjacent elements, each element having one radial arm terminating in a roller, and each element having a long part that is immersed in a fluid;

two parallel and similarly-shaped fluted rollers located side-by-side and left-to-right in close proximity to each other, each fluted roller having a wide flute and a correspondingly narrow ridge with a curved outer surface shaped so that when the ridge of the left fluted roller is in contact with the rollers of the radial arms of the rotatable elements, a trough of the wave is formed, when the ridge of the right fluted roller is in contact with the rollers of the driven arms of the rotatable elements, an apex of the wave is formed;

each fluted roller, when rotated in synchronization with the other fluted roller, having the ability to move the wave longitudinally, support means for the fluted rollers and the central axle of rotatable elements, rotational synchronization means to synchronize the rotation of the left fluted roller and the right fluted roller, power input means to provide rotational power to the left fluted roller and the right fluted roller.

2. A fluid forcing device as in claim 1, further comprising a duct enclosing the immersed parts, and the duct including grooves to recess and improve the sealing of the immersed parts, so that the fluid forcing device is capable of operating against a back pressure and operating with a higher wave-to-fluid efficiency.

3. A fluid forcing device as in claim 1, further comprising longitudinal elastic lips mounted on opposed edges of the immersed vertical parts to seal a gap between adjacent vertical parts, so that the fluid forcing device is capable of operating against a back pressure and operating with a higher wave-to-fluid coupling efficiency.

4. A fluid forcing device as in claim 1, further comprising elastic webbings between adjacent immersed parts, so that the fluid forcing device is capable of operating against a back pressure and operating with a higher wave-to-fluid coupling efficiency.

* * * * *